US005122622A

United States Patent [19]

Reuss et al.

[11] Patent Number: 5,122,622

[45] Date of Patent: Jun. 16, 1992

[54] ELECTRICAL CABLE HAVING A BEARING PART AND TWO CONCENTRICALLY ARRANGED CONDUCTORS

[75] Inventors: Thomas Reuss, Coburg; Klaus Lotter, Grossenseebach, both of Fed. Rep. of Germany

[73] Assignee: Siemens Aktiengesellschaft, Berlin and Munich, Fed. Rep. of Germany

[21] Appl. No.: 654,795

[22] Filed: Feb. 13, 1991

[30] Foreign Application Priority Data

Feb. 13, 1990 [DE] Fed. Rep. of Germany ..... 4004802

[51] Int. Cl.[5] ..... H01B 7/04

[52] U.S. Cl. ..... 174/113 C; 174/107; 174/131 A

[58] Field of Search ..... 174/1130, 131 A, 130, 174/131 R, 107

[56] References Cited

U.S. PATENT DOCUMENTS

| | | | |
|---|---|---|---|
| 2,105,168 | 1/1938 | Staples | 174/102 R |
| 2,453,418 | 11/1948 | Dunsheath et al. | 174/101.5 |
| 2,754,351 | 7/1956 | Horn | 174/105 R |
| 3,324,233 | 6/1967 | Bryant | 174/131 A |
| 4,486,623 | 12/1984 | Ploppa | 174/113 R |
| 4,538,022 | 8/1985 | Barnicol-Cottler et al. | 174/113 R |
| 4,816,611 | 3/1989 | Inverniz. | 174/102 R X |
| 4,820,012 | 4/1989 | Asai | 174/113 C X |

FOREIGN PATENT DOCUMENTS

| | | |
|---|---|---|
| 2619223 | 11/1977 | Fed. Rep. of Germany . |
| 3125164 | 3/1983 | Fed. Rep. of Germany . |

*Primary Examiner*—Morris H. Nimmo
*Attorney, Agent, or Firm*—Kenyon & Kenyon

[57] ABSTRACT

An electrical cable includes a central bearing part having a plurality of high-tensile plastic filaments. A rubber sheathing encloses the bearing part. An inner and outer conductor are twisted onto the sheathed bearing part and are disposed concentrically to one another. The inner and outer conductors each include stranded wires. The stranded wires of the inner conductor, as well as the stranded wires of the outer conductor, are twisted together to form a lay. The stranded wires of the inner conductor have the same number of lays as the stranded wires of the outer conductor but with opposite directions of lay. An inner separation layer covers the inner conductor and an outer separation layer covers the outer conductor. Additionally, a rubber insulation layer covers the outer separation layer. Finally, an outer covering encloses the outer separation layer.

9 Claims, 1 Drawing Sheet

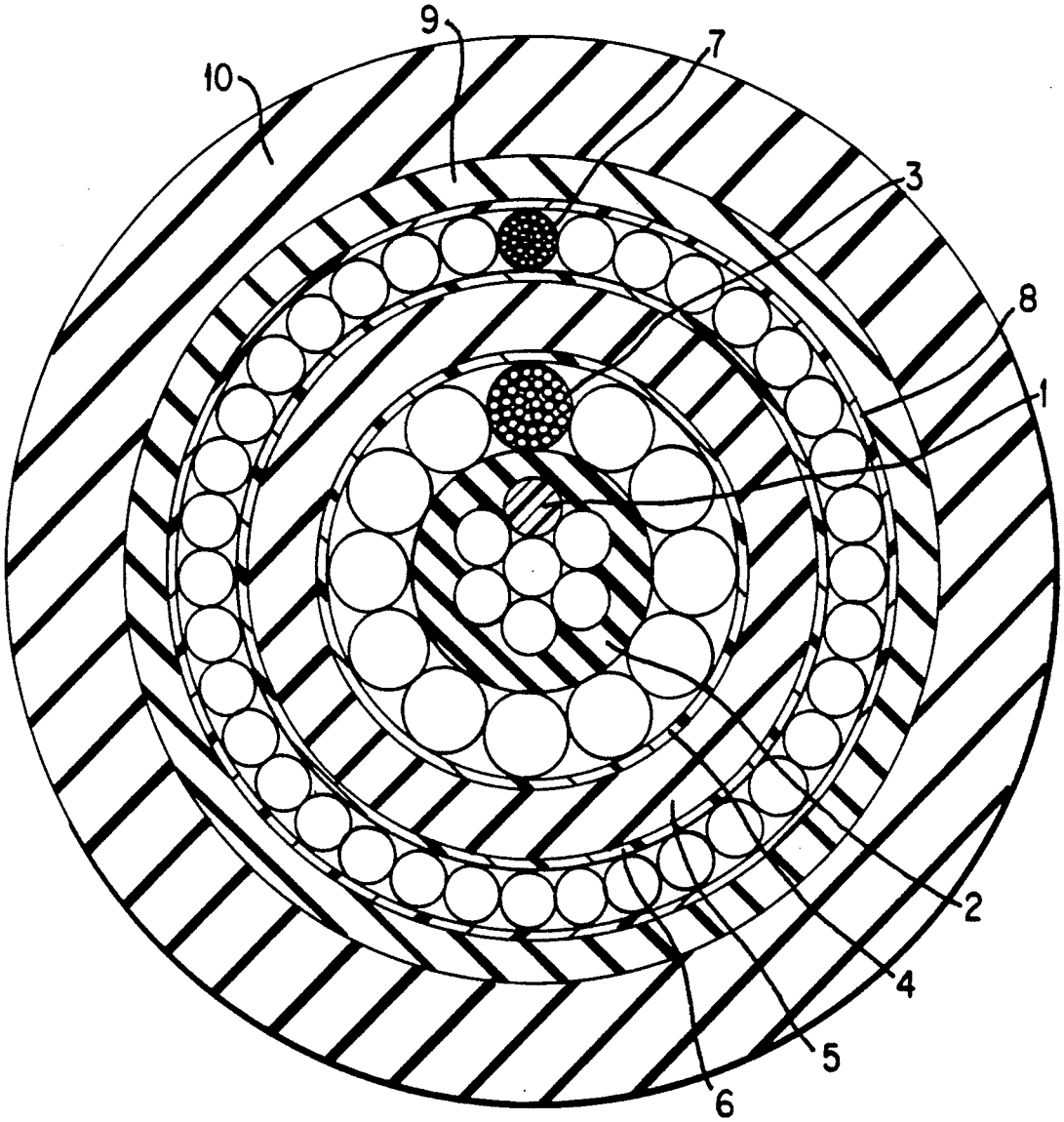
9
7
10
3
8
1
2
4
5
6

ELECTRICAL CABLE HAVING A BEARING PART AND TWO CONCENTRICALLY ARRANGED CONDUCTORS

BACKGROUND OF THE INVENTION

The invention relates generally to electrical cables and more particularly to an electrical cable having a bearing part and two concentrically arranged conductors.

Such electrical cables include a central, sheathed bearing part and two multiple-wire conductors wound on the bearing part which are disposed concentrically to one another. The two conductors are separated from each other by rubber insulation. Electrical cables formed from flexible electrical lines having a bearing part are primarily used to supply current to a mobile apparatus that uses electricity, such as a magnet in a lifting-magnet-type crane.

An electrical cable that supplies current to the pump of a bore-hole plant is disclosed in German Published Patent Application 31 25 164. This cable is comprised of three conductors arranged concentrically to one another. Each of the conductors is insulated and surrounded by a sheathing and a covering. A bearing part, which may be formed of plastic, is provided inside the first, central conductor. To assure that the cable is impermeable to water, bands made of an uncured elastomer may be provided above and below the conductor wires, which each form a stranded layer. To mechanically stabilize the cable, the conductors, which are arranged concentrically, have opposite directions of lay.

A flexible, electrical cable having a cable core which supplies current to a cutting machine is disclosed in German Published Patent Application 26 19 223. This cable has two concentrically disposed conductors. The individual wires of the inner conductor are twisted onto a rubber-sheathed bearing part made of steel stranded wires. The individual wires of the outer conductor are stranded onto the rubber insulation of the first conductor. A conductive rubber layer is extruded onto the second conductor.

The problem in the prior art is that there is no flexible electrical cable, which is tension-proof, capable of withstanding impacts and high dynamic stresses, and which is designed to supply current to a two-pole device.

SUMMARY OF THE INVENTION

The present invention provides an electrical cable that includes a central bearing part having a plurality of high-tensile plastic filaments. A rubber sheathing encloses the bearing part. An inner and outer conductor are twisted onto the sheathed bearing part and are disposed concentrically to one another. The inner and outer conductors each include stranded wires. The stranded wires of the inner conductor, as well as the stranded wires of the outer conductor, are twisted together to form a lay. The number of turns or lays v is defined by the equation $v=s/D_m$ (where s=length of each lay and $D_m$=average diameter of the stranded layer). The stranded wires of the inner conductor have the same number of lays as the stranded wires of the outer conductor but with opposite directions of lay. An inner separation layer covers the inner conductor and an outer separation layer covers the outer conductor. Additionally, a rubber insulation layer covers the outer separation layer. Finally, an outer covering encloses the rubber insulation layer.

As a result of the construction of the conductors, which each have the same number of lays, a cable having a uniform conductor load and a well-balanced torsional moment is assured. To further assure that the cable is provided with these characteristics, the two conductors both have the same electrical cross-section. This implies that the diameter of the stranded wires of the inner conductor must be larger than the diameter of the stranded wires of the outer conductor. The cable can also be provided with a high degree of flexibility and tensile strength by using stranded wires for the conductor wires, by applying a separation layer between the conductors, and by using a bearing part made of several high-tensile plastic filaments. The flexibility of the cable can be further improved by extruding on the cable a plastic film directly below the outer conductor.

BRIEF DESCRIPTION OF THE DRAWING

The sole FIGURE shows a cross-sectional view of the cable constructed according to the principles of the invention.

DETAILED DESCRIPTION

A cross-sectional view of the electrical cable of the present invention is shown in the FIGURE. A bearing part constructed of high-tensile plastic filaments 1 (Kevlar, for example) is arranged in the center of the cable. This bearing part is provided with a rubber sheathing 2 to thicken the bearing part to whatever degree is necessary. The conductor 3, whose individual conductor wires are stranded is twisted about the rubber sheathing 2. A separation layer that forms an insulating layer between the conductor 3 and the outer conductor 7 includes a wrapped covering 4 that is applied over the conductor 3. The covering 4, which is made of a plastic bonded-fiber fabric, prevents the rubber insulation 5 arranged thereabove from penetrating the clearance spaces located between the wires of the conductor 3. Furthermore, a film 6 is wrapped onto the rubber insulation 5. The film 6 protects the initially uncured rubber insulation 5 from any intrusion of the outer conductor 7 that is arranged over the insulation 5. The conductor 7 is also constructed of individual stranded wires. The diameter of the individual wires forming the conductor 7 is smaller than the diameter of the individual wires forming the inner conductor 3.

A wrapped cover 8 forming an outer separation layer is formed from a plastic bonded-fiber fabric is applied to the outer conductor 7, and a rubber insulation 9 is arranged above that. The construction of the cable from concentrically disposed elements is completed by a covering 10 formed from rubber.

During the manufacturing of the inner conductor 3 and the outer conductor 7, care is taken to wrap the stranded wires of the inner conductor 3 in a direction opposite to the stranded wires of the outer conductor 7. Both conductors 3 and 7 are twisted with the same number of lays.

The cable as constructed according to the principles of the invention assures a high resistance to transverse forces. These transverse forces may occur during a cable operation that involves continuous winding and unwinding of the cable under high tension.

What is claimed is:

1. An electrical cable comprising:

a central bearing part having a plurality of high tensile plastic filaments;

a rubber sheathing enclosing said bearing part;

an inner and outer conductor twisted onto said sheathed bearing part and disposed concentrically to one another, said inner and outer conductors each including a plurality of stranded wires;

an inner separation layer covering said inner conductor and contacting said outer conductor, and an outer separation layer covering said outer conductor;

a rubber insulation layer covering said outer separation layer; and an outer covering enclosing said rubber insulation layer, wherein the stranded wires of the inner conductor have the same number of lays about the rubber sheathing as the stranded wires of the outer conductor, said inner conductor and said outer conductor having opposite directions of lay.

2. The electrical cable of claim 1 wherein said inner and outer separation layers each comprise a wrapped, plastic bonded-fiber fabric.

3. The electrical cable of claim 1 wherein said inner separation layer further comprises a plastic film.

4. The electrical cable of claim 2 wherein said inner separation layer further comprises a plastic film.

5. The electrical cable of claim 1 wherein said inner and outer conductors have substantially the same electrical cross-section.

6. The electrical cable of claim 2 wherein said inner and outer conductors have substantially the same electrical cross-section.

7. The electrical cable of claim 3 wherein said inner and outer conductors have substantially the same electrical cross-section.

8. The electrical cable of claim 3 wherein said inner separation layer further comprises a rubber insulation layer.

9. The electrical cable of claim 4 wherein said inner separation layer further comprises a rubber insulation layer.

* * * * *